US011802465B2

(12) United States Patent
Alghamdi

(10) Patent No.: US 11,802,465 B2
(45) Date of Patent: Oct. 31, 2023

(54) ENCAPSULATED ELECTRIC SUBMERSIBLE PUMP

(71) Applicant: SAUDI ARABIAN OIL COMPANY, Dhahran (SA)

(72) Inventor: Anwar Salah S. Alghamdi, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/647,817

(22) Filed: Jan. 12, 2022

(65) Prior Publication Data

US 2023/0220750 A1 Jul. 13, 2023

(51) Int. Cl.
*E21B 43/12* (2006.01)

(52) U.S. Cl.
CPC ..... *E21B 43/128* (2013.01)

(58) Field of Classification Search
CPC ..... E21B 43/128; E21B 43/13; E21B 43/121
See application file for complete search history.

(56) References Cited

U.S. PATENT DOCUMENTS 6,033,567 A * 3/2000 Lee ..... E21B 43/121 210/512.1
6,325,143 B1 * 12/2001 Scarsdale ..... E21B 43/128 166/54.1
8,291,983 B2 10/2012 Rooks
10,865,627 B2 12/2020 Al-Zahrani
2005/0217859 A1 * 10/2005 Hartman ..... E21B 43/38 166/65.1
2006/0245957 A1 * 11/2006 Berry ..... F04B 47/06 417/423.3
2010/0122818 A1 * 5/2010 Rooks ..... E21B 43/128 166/104
2012/0012332 A1 * 1/2012 Rooks ..... E21B 43/128 166/104

(Continued)

FOREIGN PATENT DOCUMENTS

EP 2356313 B1 12/2014

OTHER PUBLICATIONS

R. Fleshman and H. O. Lekic, "Arlificial Lift for High-Volume Production", Oilfield Review; 1999; pp. 49-63 (15 pages).

(Continued)

*Primary Examiner* — David Carroll
(74) *Attorney, Agent, or Firm* — Osha Bergman Watanabe & Burton LLP

(57) ABSTRACT

A system includes production tubing, an electric submersible pump, a motor, a shroud, a motor head, and a cable. The production tubing traverses a packer and is disposed within the well. The electric submersible pump is connected to the production tubing and is located up hole from the packer. The motor is located up hole from the packer and is configured to power the electric submersible pump. The shroud encapsulates the motor, isolates the motor from an external environment, and contains a flow of produced fluids coming from the production tubing. The motor head is connected to the production tubing and extends from the external environment into the shroud. The power cable is connected to a section of the motor head that is located outside of the shroud and isolated from the produced fluids by the packer and the shroud.

16 Claims, 10 Drawing Sheets

(56) References Cited

U.S. PATENT DOCUMENTS

| | | | | |
|---|---|---|---|---|
| 2013/0068455 | A1* | 3/2013 | Brown | E21B 43/121 166/66.4 |
| 2015/0354331 | A1 | 12/2015 | Jamieson et al. | |
| 2016/0130923 | A1* | 5/2016 | Nowitzki | F04D 29/086 166/66.4 |
| 2021/0246771 | A1 | 8/2021 | Ejim et al. | |
| 2021/0270119 | A1* | 9/2021 | Brown | F04B 47/06 |

OTHER PUBLICATIONS

"REDA Maximus", Schlumberger Technology Corp.; 2006 (13 pages).

Islam Fetoui, "ESP Motor", Sep. 9, 2021; pp. 1-9; Retrieved from the Internet: URL: https://production-technology.org/esp-motor/ (9 pages).

* cited by examiner

ENCAPSULATED ELECTRIC SUBMERSIBLE PUMP

BACKGROUND

Hydrocarbon fluids are often found in hydrocarbon reservoirs located in porous rock formations far below the Earth's surface. Wells may be drilled to extract the hydrocarbon fluids from the hydrocarbon reservoirs. Most wells have a variation of downhole equipment, such as Electrical Submersible Pump (ESP) systems, installed to help with the production of hydrocarbons. Many ESP systems require deep set packers where the ESP is set downhole from the packer. This requires a packer penetration system to be used to pass the power cable of the ESP through the packer. The packer penetration system is a weak point in the ESP where a high percentage of ESP failures occur.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for producing fluids from a well. The system includes production tubing, an electric submersible pump, a motor, a shroud, a motor head, and a cable. The production tubing traverses a packer and is disposed within the well. The electric submersible pump is connected to the production tubing and is located up hole from the packer. The motor is located up hole from the packer and is configured to power the electric submersible pump. The shroud encapsulates the motor, isolates the motor from an external environment, and contains a flow of produced fluids coming from the production tubing. The motor head is connected to the production tubing and extends from the external environment into the shroud. The power cable is connected to a section of the motor head that is located outside of the shroud and isolated from the produced fluids by the packer and the shroud.

The method includes installing a production tubing into the well. The production tubing has an electric submersible pump, a motor encapsulated by a shroud, and a packer. The electric submersible pump and the motor are located up hole from the packer. The method further includes powering the electric submersible pump by transferring energy from a power cable to the motor using a motor head. The power cable is connected to a section of the motor head located outside of the shroud. The method finally includes pumping produced fluids from an inside of the production tubing, into the shroud, into the electric submersible pump, and out of the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
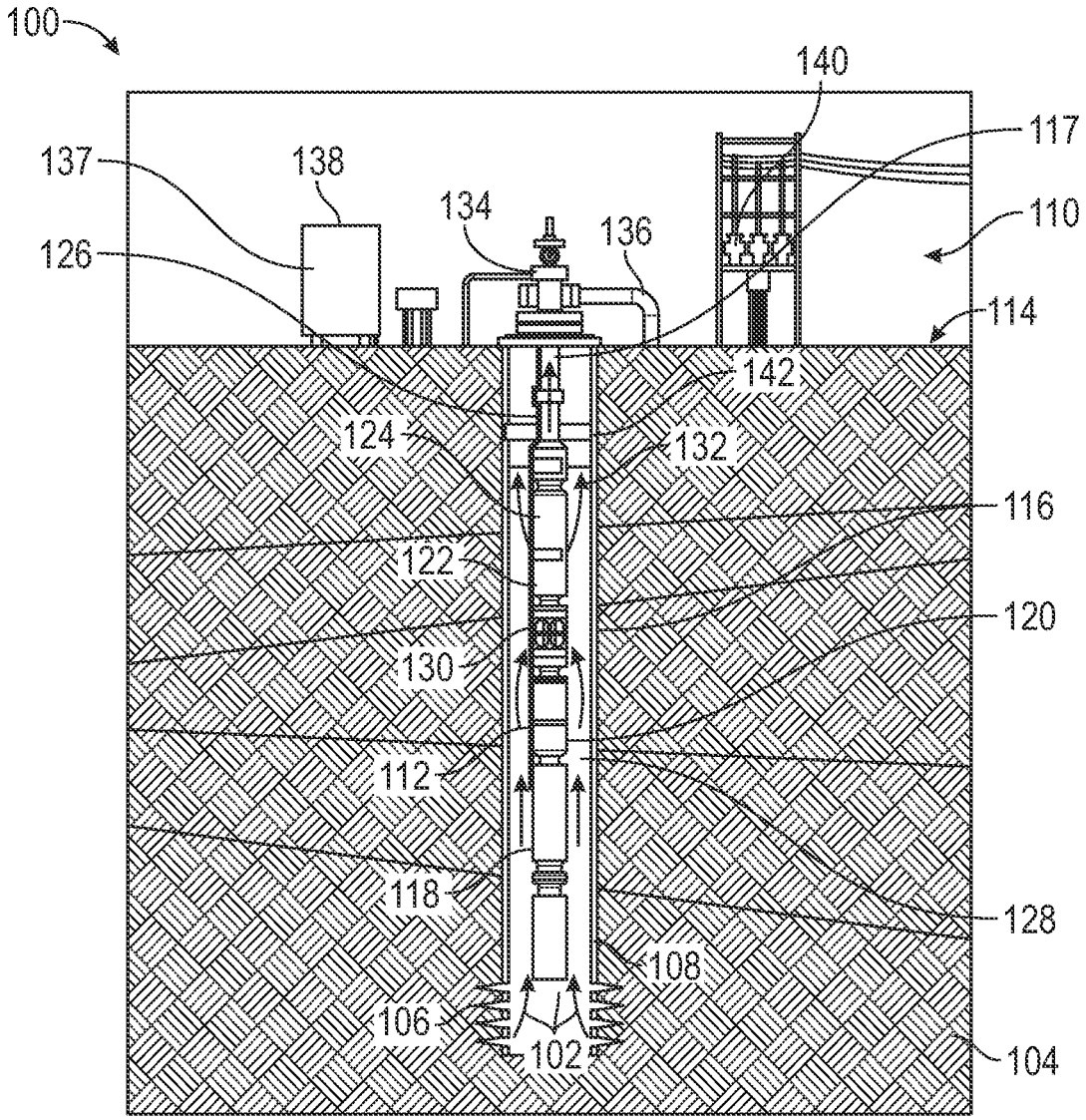
FIG. 1 shows an exemplary electric submersible pump (ESP) system in accordance with one or more embodiments.

FIG. 1 shows an exemplary ESP system (100) in accordance with one or more embodiments. The ESP system (100) is used to help produce produced fluids (102) from a formation (104). Perforations (106) in the well's (116) casing (108) provide a conduit for the produced fluids (102) to enter the well (116) from the formation (104). The ESP system (100) includes a surface portion having surface equipment (110) and a downhole portion having an ESP string (112).

The ESP string (112) is deployed in a well (116) on production tubing (117) and the surface equipment (110) is located on a surface location (114). The surface location (114) is any location outside of the well (116), such as the Earth's surface. The production tubing (117) extends to the surface location (114) and is made of a plurality of tubulars connected together to provide a conduit for produced fluids (102) to migrate to the surface location (114).

The ESP string (112) may include a motor (118), motor protectors (120), a gas separator (122), a multi-stage centrifugal pump (124) (herein called a "pump" (124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface location (114). The motor (118) is cooled by the produced fluids (102) passing over the motor (118) housing. The motor (118) is powered by the power cable (126). The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116).

Motor protectors (120) are located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface location (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity.

The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface location (114). The ESP string (112) outlined in FIG. 1 may be described as a standard ESP string (112), however, the term ESP string (112) may be referring to a standard ESP string (112) or an inverted ESP string (112) without departing from the scope of the disclosure herein.

A packer (142) is disposed around the ESP string (112). Specifically, the packer (142) is located above (i.e., closer to the surface location (114)) the multi-stage centrifugal pump (124). The packer (142) may be any packer (142) known in the art such as a mechanical packer (142). The packer (142) seals the annulus (128) space located between the ESP string (112) and the casing (108). This prevents the produced fluids (102) from migrating past the packer (142) in the annulus (128).

In other embodiments, sensors may be installed in various locations along the ESP string (112) to gather downhole data such as pump intake volumes, discharge pressures, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface location (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137) and pump control equipment (138) as well as an electric power supply (140). The electric power supply (140) provides energy to the motor (118) through the power cable (126). The electric power supply (140) may be a commercial power distribution system or a portable power source such as a generator.

The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Many ESP systems (100) require deep set packers (142) where the pump (124) is set downhole from the packer (142). This requires a packer (142) penetration system to be used to pass the power cable (126) of the pump (124) through the packer (142). The packer (142) penetration system is a weak point in the ESP system (100) where a high percentage of ESP system (100) failures occur. Therefore, systems and methods that prevent the power cable from passing through the packer are beneficial. As such, embodiments disclosed herein present an ESP string (112) design that encapsulates the motor (118) and allows the electrical connections between the power cable (126) and the motor (118) to occur in an environment absent of produced fluids (102) using a motor head (200).

Figure 2A:
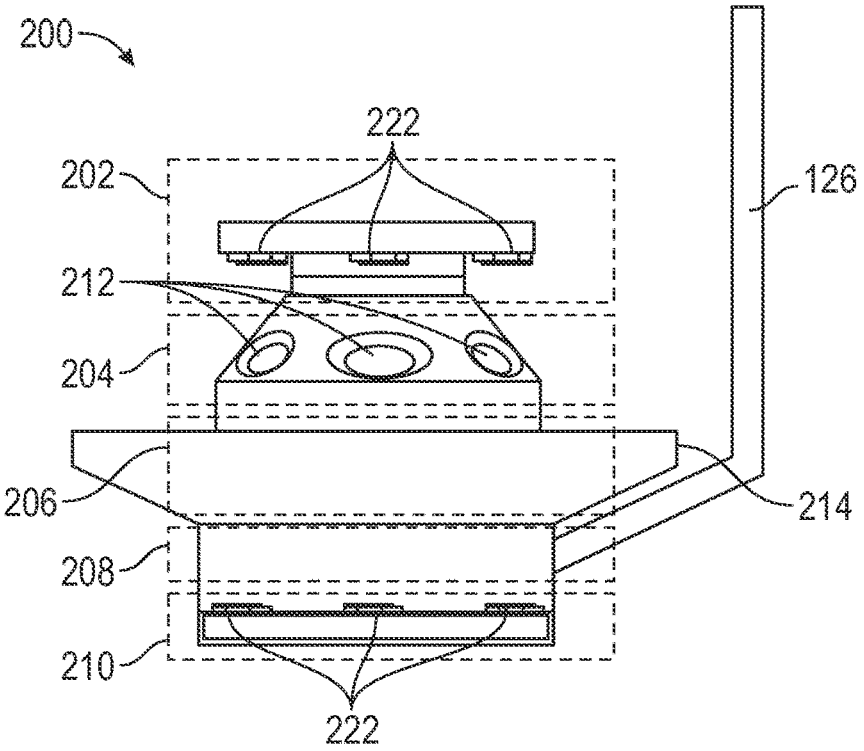
FIGS. 2*a* and 2*b* show a motor head in accordance with one or more embodiments.
Figure 2B:
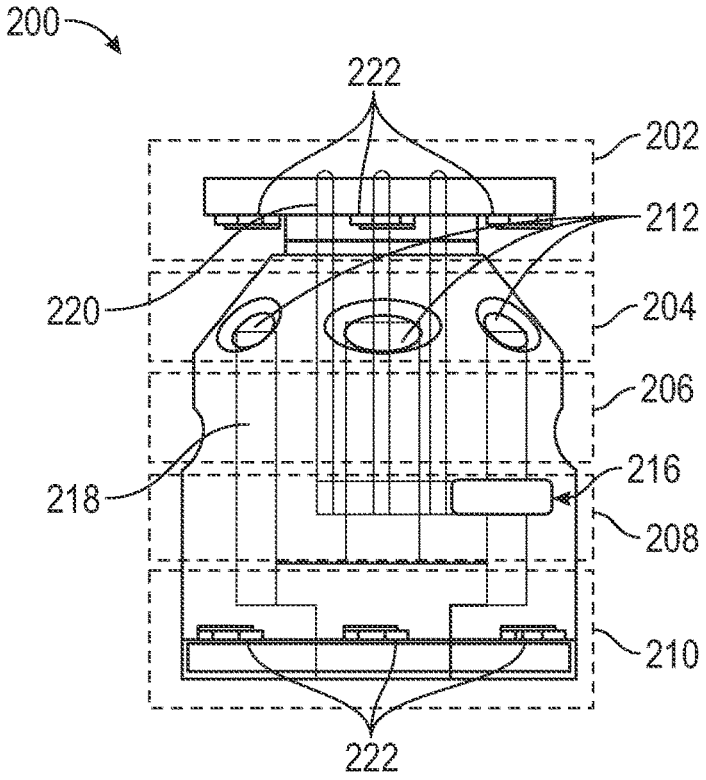

FIGS. 2*a* and 2*b* show a motor head (200) in accordance with one or more embodiments. Specifically, FIG. 2*a* shows a side view of the motor head (200) and FIG. 2*b* shows a transparent side view of the motor head (200). The motor head (200) may be divided into five sections: a first section (202), a second section (204), a third section (206), a fourth section (208), and a fifth section (210). The motor head (200) may be made out of any durable material known in the art, such as a steel alloy.

FIG. 2*a* shows the power cable (126) connected to the fourth section (208) of the motor head (200), holes (212) located on the second section (204) of the motor head (200), and a shroud hanger (214) connected to the third section (206) of the motor head (200). FIG. 2*b* shows a power inlet (216) located on the fourth section (208). In accordance with one or more embodiments, the power cable (126) is connected to the power inlet (216). A plurality of connection points (222) are shown on the first section (202) and the fifth section (210) of the motor head (200). The connection points (222) are the locations along the motor head (200) that are used to connect the motor head (200) to another piece of equipment, such as the ESP string (112) described in FIG. 1.

A flow path (218) and phase pins (220) are shown extending through the inside of the motor head (200). The flow path (218) is configured to transport a fluid, such as the produced fluids (102), through the motor head (200). The flow path (218) may begin as a singular flow path that branches into three flow paths. The flow path (218) may begin in the fifth section (210) and may extend to the holes (212) on the second section (204). Fluid may flow in either direction within the flow path (218).

As shown in FIG. 2*b*, there may be three phase pins (220) extending from the first section (202) to the power inlet (216), located in the fourth section (208). The phase pins (220) are electrically conductive and are configured to conduct electricity provided by the power cable (126). The three phase pins (220) may be joined near the power inlet (216) by a common base that is connected to the power inlet (216). That is, the phase pins (220) may begin as a singular phase pin (220) at the power inlet (216) and may branch into three separate phase pins (220) within the motor head (200).

FIGS. 3*a*-7*b* show a top view and a bottom view of each section of the motor head (200). The top view may be defined as the view looking down on the section from the direction of the first section (202). The bottom view may be defined as the view looking up on the section from the direction of the fifth section (210). Components shown in FIGS. 3*a*-7*b* that have been described in previous figures have not been redescribed for purposes of readability and have the same function and description as previously outlined.

Figure 3A:
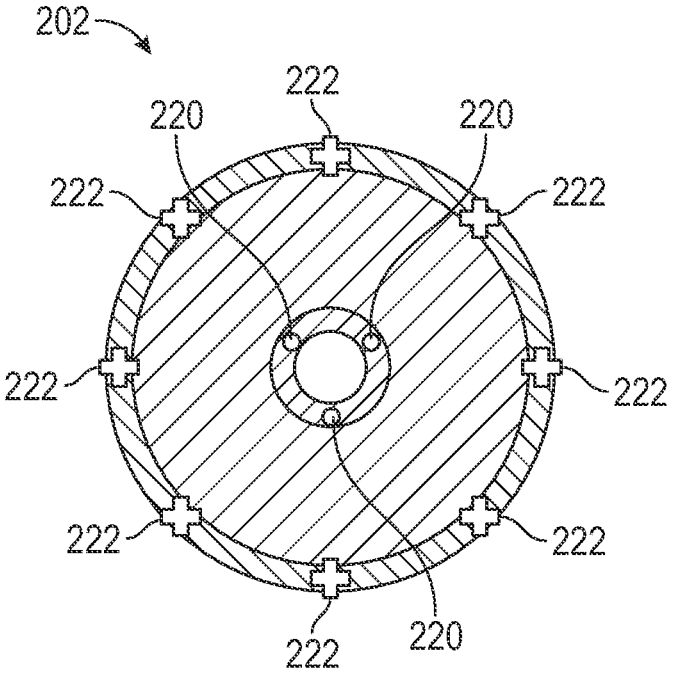
FIG. 3*a* shows a top view of the first section and FIG. 3*b* shows a bottom view of the first section in accordance with one or more embodiments.

FIG. 3*a* shows the top view of the first section (202) in accordance with one or more embodiments. The top view of the first section (202) shows the first section (202) having a circular-like shape with a plurality of connection points (222) located around a circular path distal the center of the top view of the first section (202). In accordance with one or more embodiments, the connection points (222) may be bolt holes. The bolt holes may line up with corresponding bolt holes on another piece of equipment to connect the motor head (200) to said piece of equipment. The bolt holes and corresponding bolt holes may be configured to receive a bolt secured in place by a nut. FIG. 3*a* also shows the three phase pins (220) located around a circular path proximal the center of the top view of the first section (202).

Figure 3B:
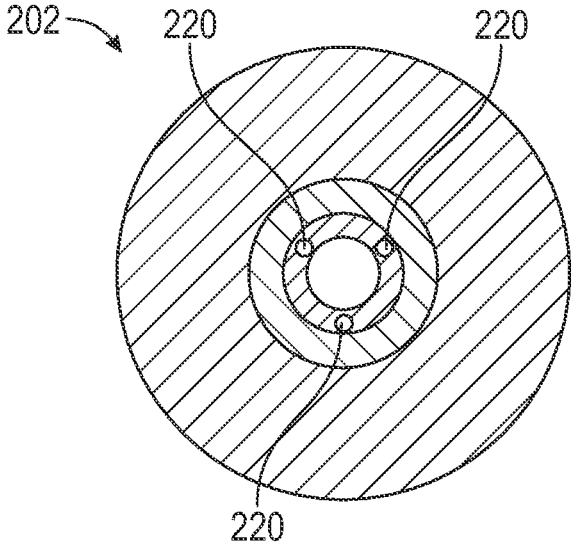

FIG. 3*b* shows the bottom view of the first section (202) in accordance with one or more embodiments. In accordance with one or more embodiments, the circumference of the top portion (top portion referring to the portion closest to the top view) of the first section (202) is larger than the circumference of the bottom portion (bottom portion closest to the portion near the bottom view) of the first section (202) as shown in FIGS. 2*a* and 2*b*. The three phase pins (220) are shown as located around the circular path proximal the center of the bottom view of the first section (202).

Figure 4A:
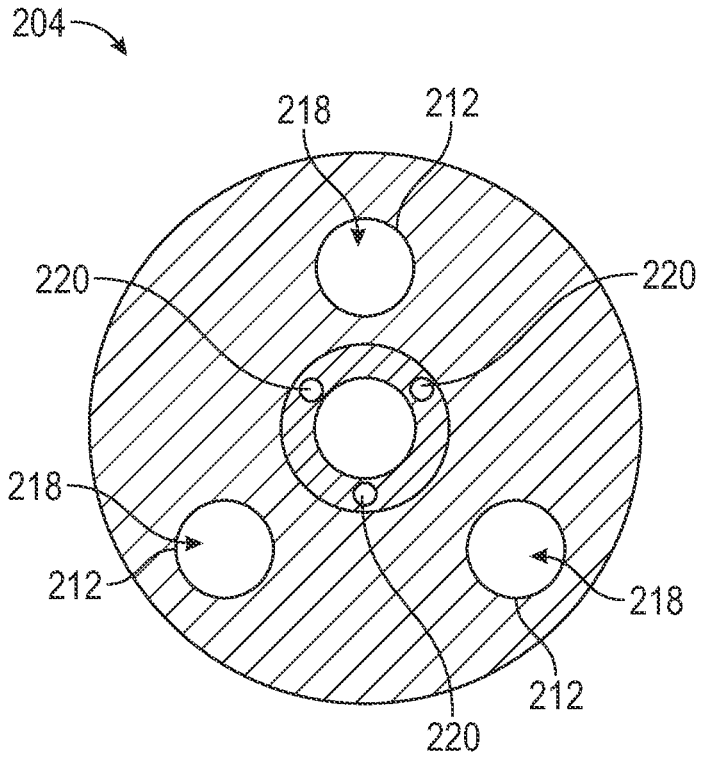
FIG. 4*a* shows a top view of the second section and FIG. 4*b* shows a bottom view of the second section in accordance with one or more embodiments.
Figure 4B:
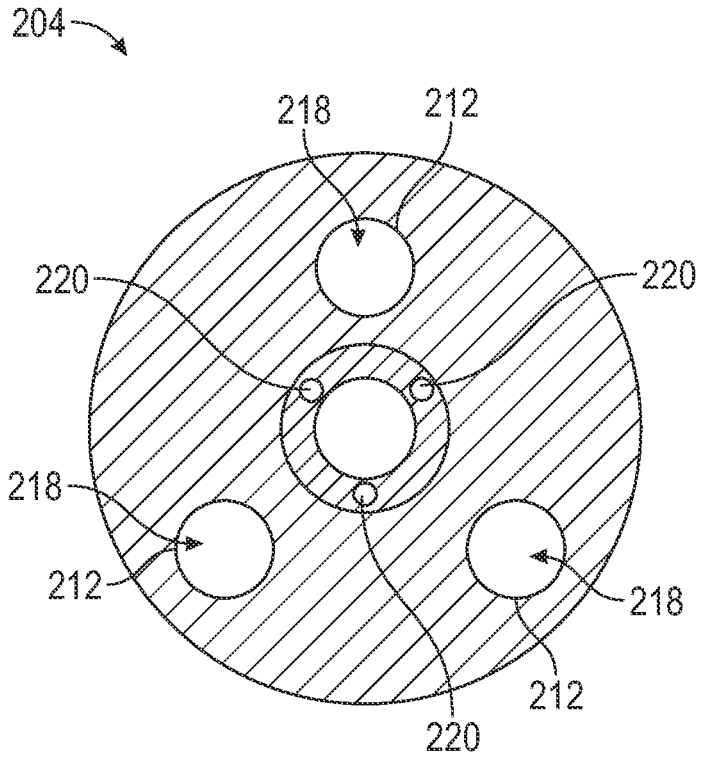

FIG. 4*a* shows the top view of the second section (204) and FIG. 4*b* shows the bottom view of the second section (204) in accordance with one or more embodiments. The top view and the bottom view of the second section (204) are the same. The three phase pins (220) are shown as located around a circular path proximal the center of the bottom view and the center of the top view of the second section (204). Three holes (212) are shown as located around a circular path distal the center of the bottom view and the center of the top view of the second section (204). The holes (212) define the flow path (218) that the fluid may follow through the motor head (200).

Figure 5A:
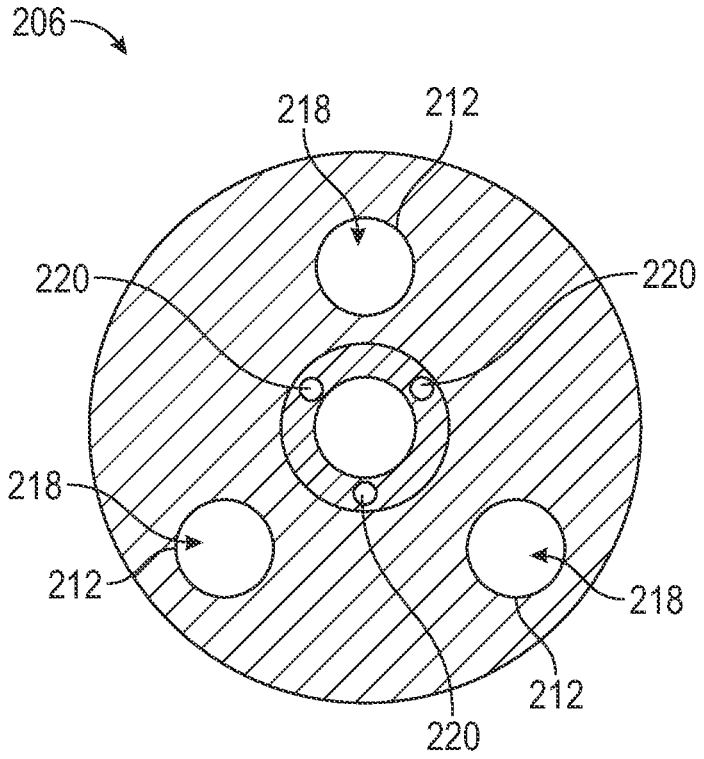
FIG. 5*a* shows a top view of the third section and FIG. 5*b* shows a bottom view of the third section in accordance with one or more embodiments.
Figure 5B:
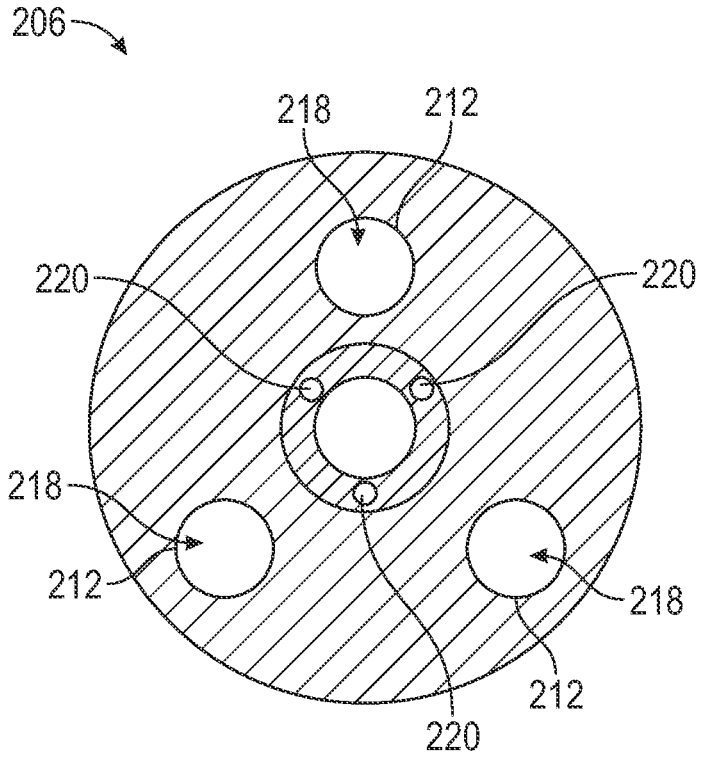

FIG. 5*a* shows the top view of the third section (206) and FIG. 5*b* shows the bottom view of the third section (206) in accordance with one or more embodiments. The top view and the bottom view of the third section (206) are the same. The three phase pins (220) are shown as located around a circular path proximal the center of the bottom view and the center of the top view of the third section (206). Three holes (212) are shown as located around a circular path distal the center of the bottom view and the center of the top view of the third section (206). The holes (212) define the flow path (218) that the fluid may follow through the motor head (200).

Figure 6A:
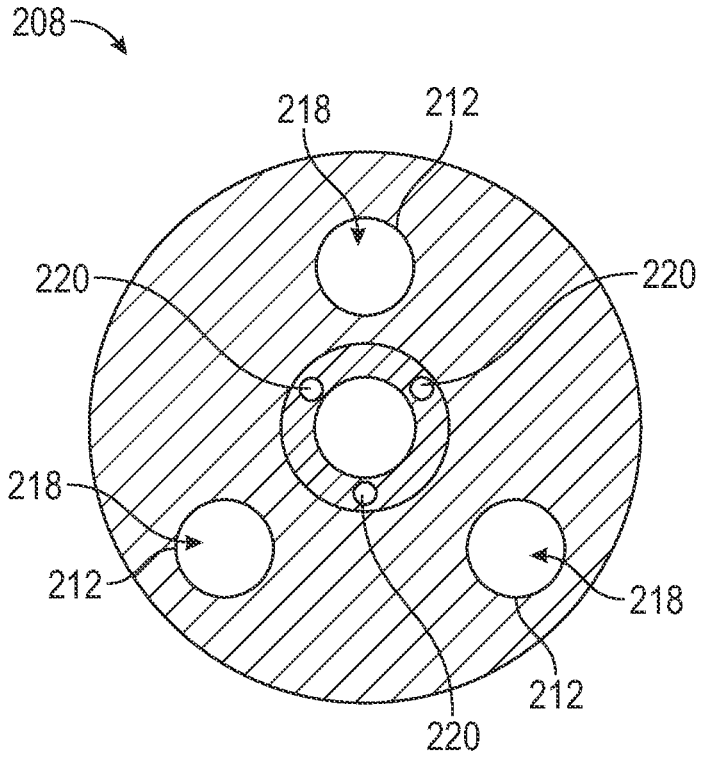
FIG. 6*a* shows a top view of the fourth section and FIG. 6*b* shows a bottom view of the fourth section in accordance with one or more embodiments.
Figure 6B:
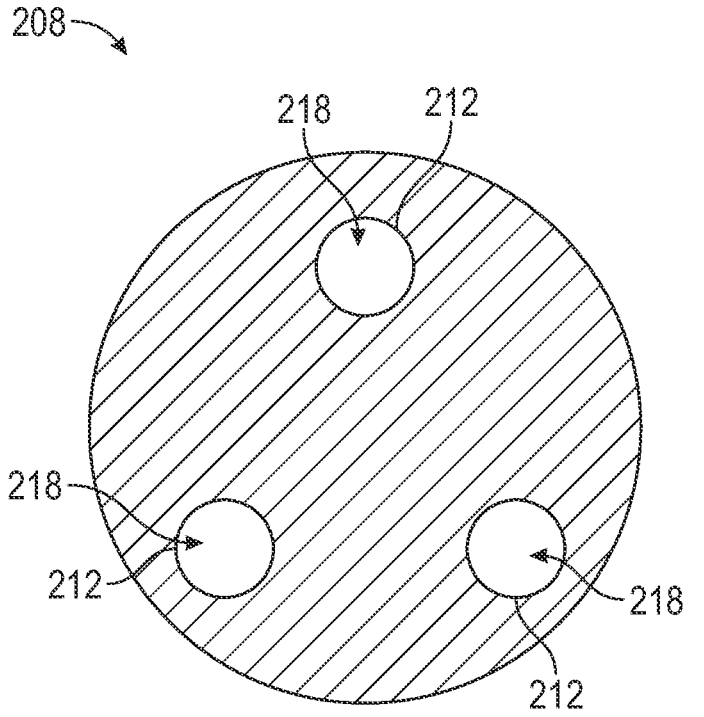

FIG. 6*a* shows the top view of the fourth section (208) and FIG. 6*b* shows the bottom view of the fourth section (208) in accordance with one or more embodiments. The three phase pins (220) are shown as located around a circular path proximal the center of the top view of the fourth section (208). Three holes (212) are shown as located around a circular path distal the center of the top view of the fourth section (208). The bottom view of the fourth section has no phase pins. Three holes (212) are shown as located around a circular path distal the center of the bottom view of the fourth section (208). The holes (212) shown in the top view and the bottom view of the fourth section (208) define the flow path (218) that the fluid may follow through the motor head (200).

Figure 7A:
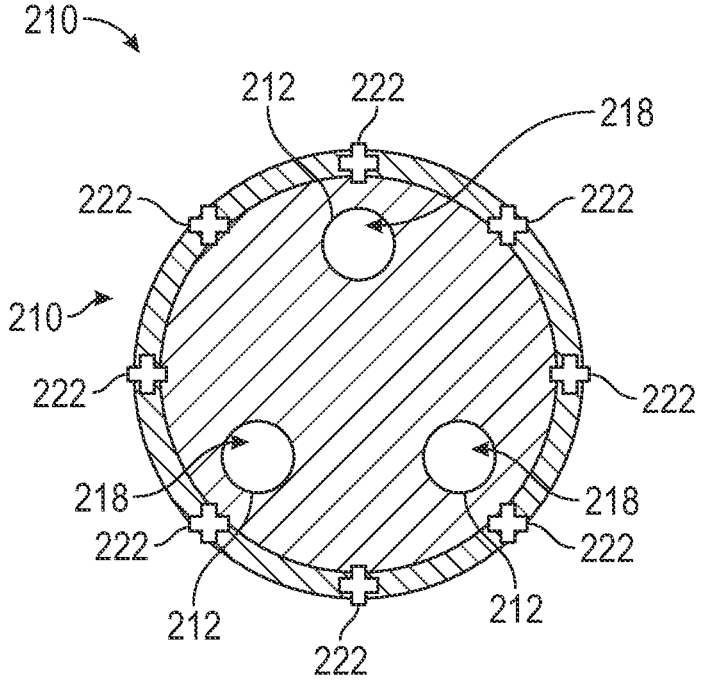
FIG. 7*a* shows a top view of the fifth section and FIG. 7*b* shows a bottom view of the fifth section in accordance with one or more embodiments.
Figure 7B:
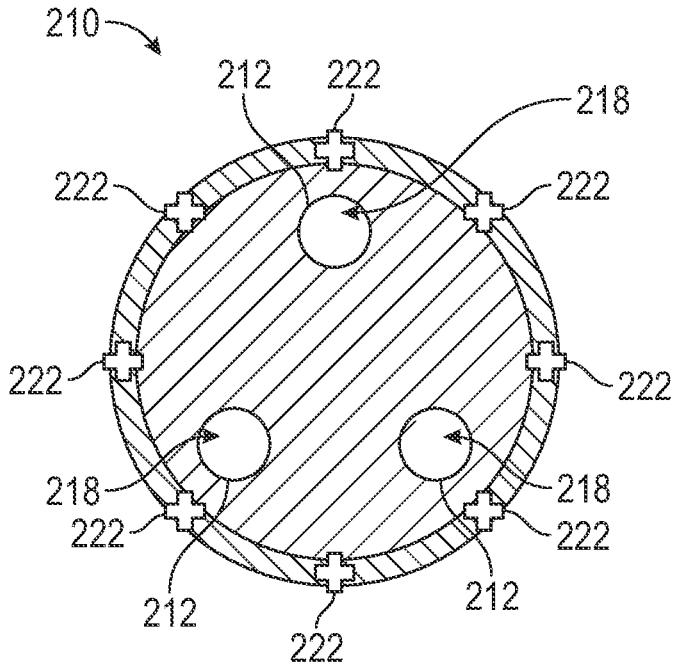

FIG. 7*a* shows the top view of the fifth section (210) and FIG. 7*b* shows the bottom view of the fifth section (210) in accordance with one or more embodiments. The top view and the bottom view of the fifth section (210) are the same. A plurality of connection points (222) are located around a circular path distal the center of the top view and the center of the bottom view of the fifth section (210). The connection points (222) are the locations along the motor head (200) that are used to connect the motor head (200) to another piece of equipment, such as an ESP string (112).

Three holes (212) are shown as located around a circular path distal the center of the bottom view and the center of the top view of the fifth section (210). The holes (212) define the flow path (218) that the fluid may follow through the motor head (200). The holes (212) shown in FIGS. 4*a*-7*b* may line up with one another from section to section. Further, the fluid may enter the motor head (200) using the holes (212) located on the bottom view of the fifth section (210) and may exit the motor head (200) using the holes (212) located on the top view of the second section (204). In other embodiments, the fluid may enter the motor head (200) using the holes (212) located on the top view of the second section (204) and may exit the motor head (200) using the holes (212) located on the bottom view of the fifth section (210).

Figure 8:
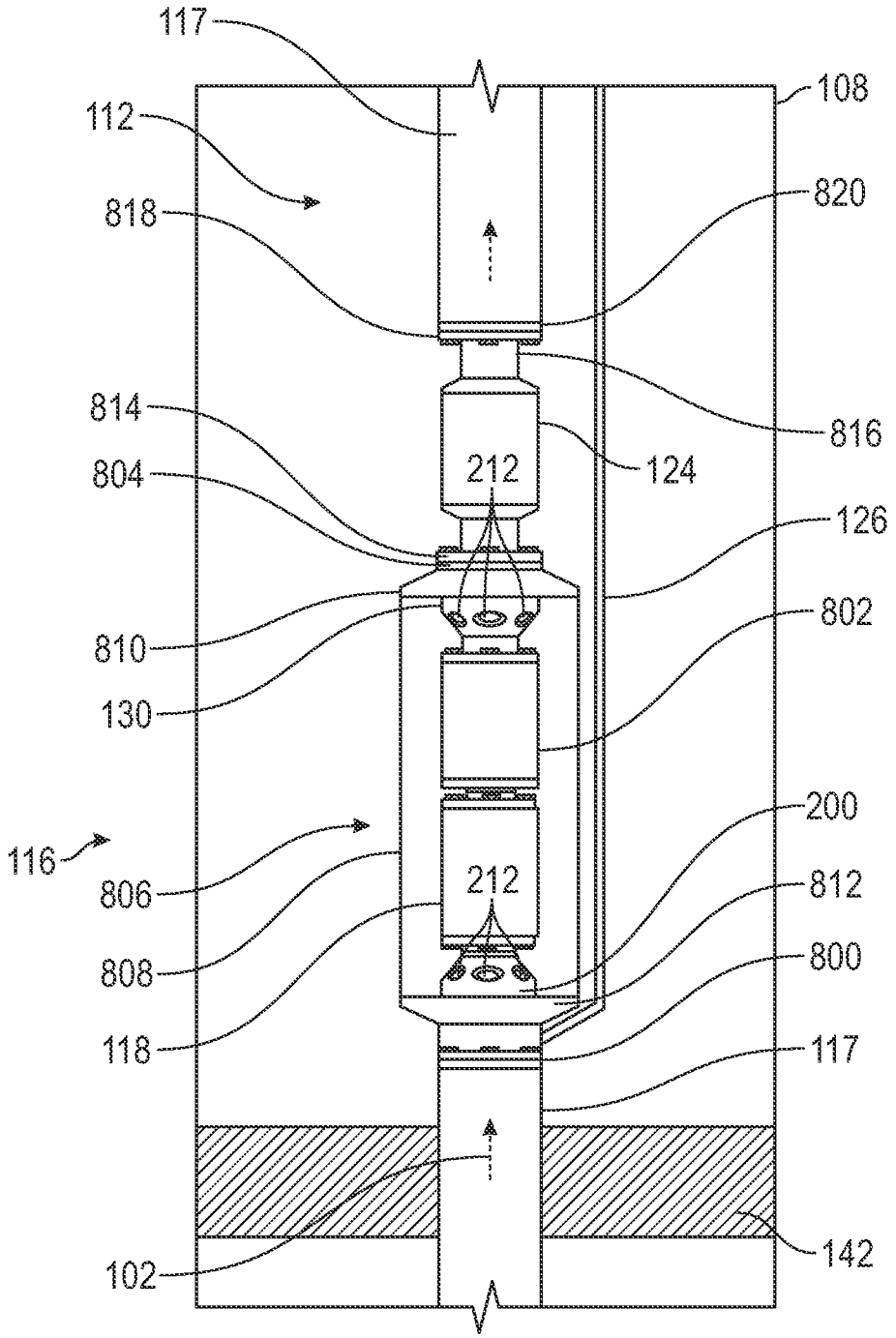
FIG. 8 shows an ESP string in accordance with one or more embodiments.

FIG. 8 shows a standard ESP string (112) design in accordance with one or more embodiments. Components shown in FIG. 8 that have been described in FIGS. 1-7*b* have not been redescribed for purposes of readability and have the same description and purpose as outlined above. The standard ESP string (112) design shown in FIG. 8 has production tubing (117) disposed within a well (116) and traversing a packer (142). The packer (142) is set within the casing (108) of the well (116). A motor (118), an electric submersible pump (124), and a motor head (200) are connected to the production tubing (117) and are located up hole from the packer (142).

Specifically, the motor head (200) is connected to the production tubing (117) up hole and adjacent to the packer (142). In accordance with one or more embodiments, the fifth section (210) of the motor head (200) is connected to the production tubing (117) using a lower tubing connection flange (800). The lower tubing connection flange (800) mates with the connection points (222) on the fifth section (210) of the motor head (200). For example, the connection points (222) on the motor head (200) may be bolt holes that mate with corresponding bolt holes on the lower tubing connection flange (800). A bolt may be inserted and secured into the bolt holes using a nut.

The lower tubing connection flange (800) may be threaded into the production tubing (117), or the lower tubing connection flange (800) may be machined as part of the production tubing (117). Similarly, the first section (202) of the motor head (200) is connected to the motor (118), and the motor (118) is connected to an ESP seal (802). The phase pins (220) extend from the first section (202) of the motor head (200) into the motor (118) to transfer energy from the power cable (126) to the motor (118).

The ESP seal (802) may contain one or more seals used to prevent fluid from entering the motor (118). In accordance with one or more embodiments, the ESP seal (802) may be similar to the motor protectors (120) as described in FIG. 1. The ESP seal (802) is connected to the pump intake (130). The pump intake (130) includes a pump intake neck (804) and holes (212). The holes (212) are located on the pump intake (130) downhole from the pump intake neck (804). The holes (212) enable a fluid, such as the produced fluids (102), to enter the pump intake (130).

The motor head (200) extends into a shroud (806) such that the holes (212) of the motor head (200), the motor (118), ESP seal (802), and the holes (212) of the pump intake (130) are encapsulated by the shroud (806). The shroud (806) includes a shroud body (808), an upper shroud hanger (810), and a lower shroud hanger (812). The shroud body (808) is formed in a cylindrical-like shape around the holes (212) of the motor head (200), the motor (118), ESP seal (802), and the holes (212) of the pump intake (130). The upper shroud hanger (810) and the lower shroud hanger (812) cap the shroud body (808) on opposite ends of the shroud body (808).

The shroud (806) encapsulates the motor (118) and isolates the motor (118), ESP seal (802), and the portion of the pump intake (130) from an external environment and contains a flow of produced fluids (102) coming from the production tubing (117). The shroud (806) may be made out of any durable material known in the art, such as steel. In accordance with one or more embodiments, the lower shroud hanger (812) is connected to the third section (206) of the motor head (200) such that the first section (202), the second section (204), and the third section (206) are located inside of the shroud (806) and are in contact with the produced fluids (102).

The fourth section (208) and the fifth section (210) are located outside of the shroud (806). The power cable (126) is connected to, or plugged into, the power inlet (216) on the fourth section (208) of the motor head (200). The fourth section (208) is located in the external environment of the shroud (806) and is isolated from the produced fluids (102) by the packer (142) and the shroud (806). The upper shroud hanger (810) is connected to the pump intake neck (804). These connections may be made using any means known in the art, such as welding.

The pump intake neck (804) is connected to the pump (124) using a lower pump connection flange (814). This connection may occur using any means known in the art, such as bolting the two components together. The lower pump connection flange (814) may be machined as part of the pump (124) or threaded into the pump (124). The pump (124) has a pump discharge (816) located on the opposite side of the pump (124) from the lower pump connection flange (814). An upper pump connection flange (818) is located on the pump discharge (816). The upper pump connection flange (818) may be machined as part of the pump discharge (816) or threaded into the pump discharge (816).

The upper pump connection flange (818) mates with an upper tubing connection flange (820) to connect the production tubing (117) to the pump (124). The upper tubing connection flange (820) may be threaded into the production tubing (117), or the upper tubing connection flange (820) may be machined as part of the production tubing (117). The connection between the upper tubing connection flange (820) and the upper pump connection flange (818) may occur using any means known in the art, such as bolting the two components together.

In accordance with one or more embodiments, the produced fluids (102) enter the well (116) through perforations (106) in the casing (108). The produced fluids (102) travel up hole using the production tubing (117). The produced fluids (102) enter the fifth section (210) of the motor head (200) using the connection between the motor head (200) and the production tubing (117). The produced fluids (102) exit the motor head (200) using the holes (212) in the second section (204) of the motor head (200) into the shroud (806).

The produced fluids (102) bypass the motor (118) and the ESP seal (802), while inside of the shroud (806), and enter the pump intake (130) through the holes (212) located on the pump intake (130). The produced fluids (102) travel from the pump intake (130) into the pump (124), powered by the motor (118). The pump (124) pumps the produced fluids (102) back into the production tubing (117) using the pump discharge (816). In accordance with one or more embodiments, the pump pressure provided by the pump pushes the produced fluids (102) to the surface location (114).

Figure 9:
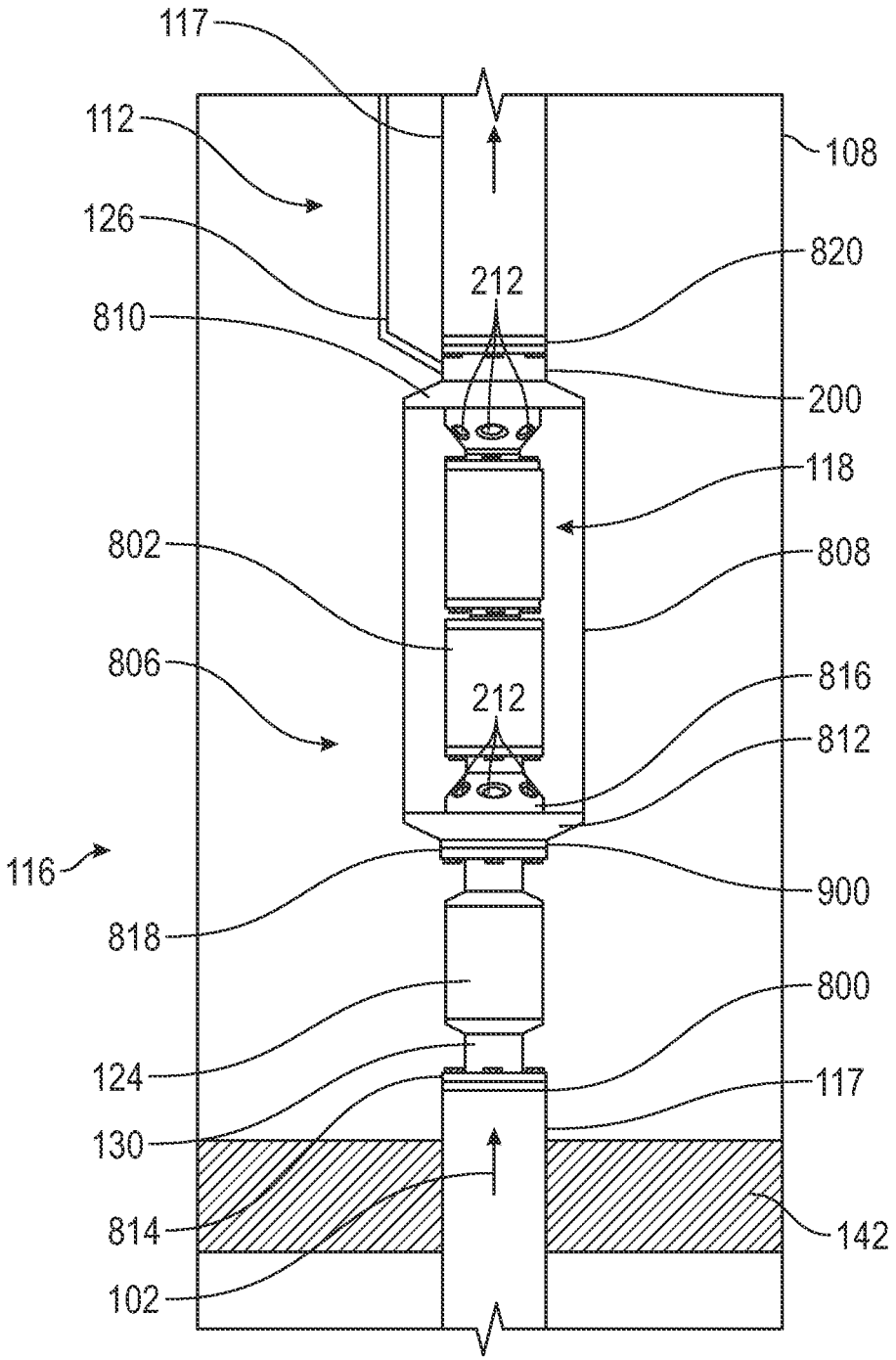
FIG. 9 shows an inverted ESP string in accordance with one or more embodiments.

FIG. 9 shows an inverted ESP string (112) design in accordance with one or more embodiments. Components shown in FIG. 9 that have been described in FIGS. 1-8 have not been redescribed for purposes of readability and have the same description and purpose as outlined above. The inverted ESP string (112) design shown in FIG. 9 has production tubing (117) disposed within a well (116) and traversing a packer (142). The packer (142) is set within the casing (108) of the well (116). A motor (118), an electric submersible pump (124), and a motor head (200) are connected to the production tubing (117) and are located up hole from the packer (142).

The inverted ESP string (112) has the pump (124) located downhole from the motor (118), whereas in FIG. 8, the pump (124) is located up hole from the motor (118). In the inverted ESP string, the pump intake (130) is disposed adjacent to the packer (142). The pump intake (130) may be a pipe. The production tubing (117) has a lower tubing connection flange (800). The pump intake (130) is connected to the lower tubing connection flange (800) using the lower pump connection flange (814).

In the inverted ESP string (112), the pump intake (130) may be a component of the pump (124), and the pump intake (130) may not have any holes (212) on the outer surface of the pump intake (130). Rather, the pump discharge (816) may have the plurality of holes (212) any may not be machined as part of the pump (124). Further, the pump discharge (816) has a pump discharge neck (900) that is connected to the upper pump connection flange (818) of the pump (124), as shown in FIG. 9.

The lower shroud hanger (812) is connected to a section of the pump discharge (816) between the holes (212) and the pump discharge neck (900). The pump discharge (816) is connected to the ESP seal (802), the ESP seal (802) is connected to the motor (118), and the motor (118) is connected to the first section (202) of the motor head (200). The upper shroud hanger (810) is connected to the third section (206) of the motor head (200). The fifth section (210) of the motor head (200) is connected to the upper tubing connection flange (820) of the production tubing (117).

The power cable (126) is connected to the power inlet (216) on the fourth section (208) of the motor head (200). The shroud (806) encapsulates the holes (212) of the pump discharge (816), the ESP seal (802), the motor (118), and the holes (212) of the motor head (200). The power cable (126) and the power inlet (216) are located in the external environment outside of the shroud (806) and up hole from the packer (142), thus the power cable (126) to power inlet (216) connection may be performed in an environment with no produced fluids (102).

In accordance with one or more embodiments, the produced fluids (102) enter the well (116) through perforations (106) in the casing (108). The produced fluids (102) travel up hole using the production tubing (117). The produced fluids (102) enter the pump (124), powered by the motor (118), using the pump intake (130) connected to the production tubing (117). The pump (124) pumps the produced fluids (102) into the shroud (806) using the holes (212) of the pump discharge (816).

The produced fluids (102) bypass the ESP seal (802) and the motor (118), while inside of the shroud (806), and enter the motor head (200) through the holes (212) located on the third section (206) of the motor head (200). The produced fluids (102) travel from the motor head (200) back into the production tubing (117). In accordance with one or more embodiments, the pump pressure provided by the pump (124) pushes the produced fluids (102) to the surface location (114).

Figure 10:
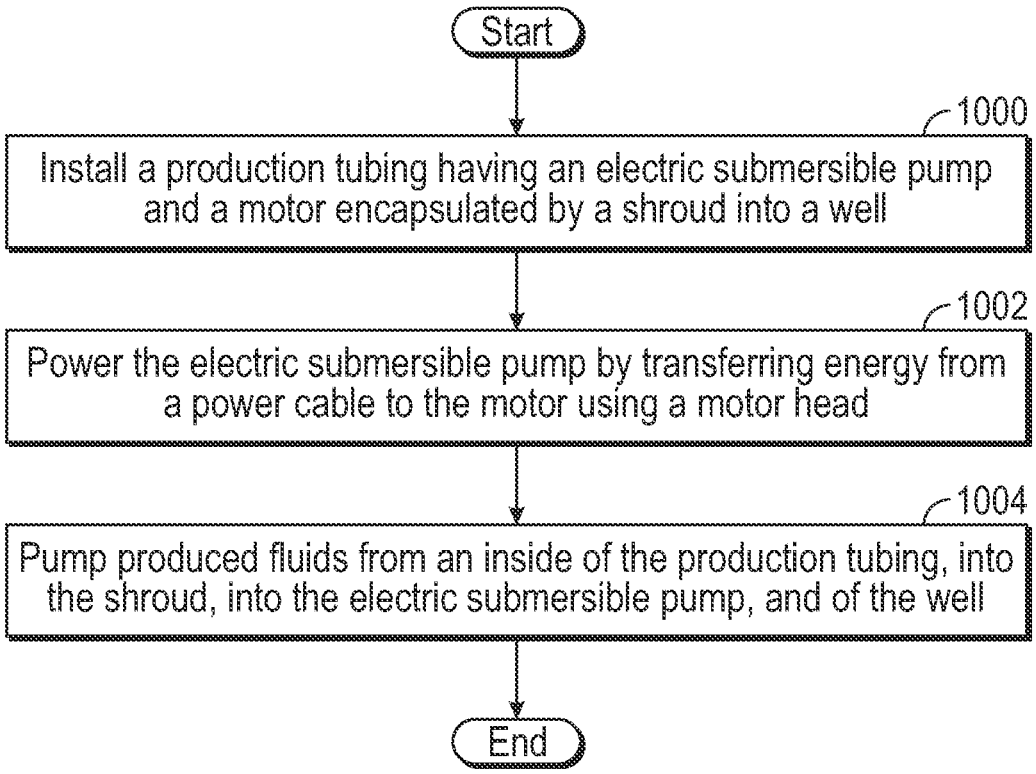
FIG. 10 shows a flowchart in accordance with one or more embodiments.

FIG. 10 shows a flowchart in accordance with one or more embodiments. The flowchart outlines a method for producing produced fluids (102) from a well (116). While the various blocks in FIG. 10 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a production tubing (117) having an electric submersible pump (124) and a motor (118) encapsulated by a shroud (806) is installed in a well (116) (S1000). The production tubing (117) further includes a packer (142). The pump (124) and the motor (118) are located up hole from the packer (142) when installed in the well (116). The production tubing (117) may be a part of a standard ESP string (112), as shown in FIG. 8, or the production tubing (117) may be part of an inverted ESP string (112) as shown in FIG. 9.

In both the standard ESP string (112) and the inverted ESP string (112), the shroud (806) is connected to the motor head (200) and the shroud (806) encapsulates the holes (212) of the motor head (200), the motor (118), and the ESP seal (802). The motor head (200) is made up of a first section (202), a second section (204), a third section (206), a fourth section (208), and a fifth section (210). The first section (202), the second section (204), and the third section (206) of the motor head (200) are located inside of the shroud (806) and are in contact with produced fluids. The fourth section (208) and the fifth section (210) are located outside of the shroud (806). The shroud (806) is made of a shroud body (808), an upper shroud hanger (810), and a lower shroud hanger (812).

In accordance with one or more embodiments, the production tubing (117) is part of the standard ESP string (112) made up of the following components described in the order in which they appear (downhole to up hole) when installed in the well (116): a packer (142), a motor head (200), a motor (118), an ESP seal (802), a pump intake (130), a pump (124), and a pump discharge (816) all installed along the production tubing (117). Further, the lower shroud hanger (812) is connected to third section (206) of the motor head (200), and the upper shroud hanger (810) is connected to the pump intake neck (804).

In accordance with other embodiments, the production tubing (117) is part of the inverted ESP string (112) made up of the following components described in the order in which they appear (downhole to up hole) when installed in the well (116): a packer (142), a pump intake (130), a pump (124), a pump discharge (816), an ESP seal (802), a motor (118), and a motor head (200). Further, the upper shroud hanger (810) is connected to the third section (206) of the motor head (200), and the lower shroud hanger (812) is connected to the pump discharge neck (900).

The electric submersible pump (124) is powered by transferring energy from a power cable (126) to the motor (118) using a motor head (200) (1002). The power cable (126) is connected to a section of the motor head (200) located outside of the shroud (806). In accordance with one or more embodiments, the power cable (126) is connected to a power inlet (216) located on the fourth section (208) of the motor head (200). Because the fourth section (208) of the motor head (200) is located outside of the shroud (806) and up hole from the packer (142), this connection is made in an external environment free of produced fluids (102).

Produced fluids (102) are pumped from an inside of the production tubing (117), into the shroud (806), into the electric submersible pump (124), and out of the well (116) (S1004). More specifically, and in the standard ESP string (112) configuration, the produced fluids (102) enter the inside of the production tubing (117) and travel up hole to the motor head (200). The produced fluids (102) exit the motor head (200) into the shroud (806) through the holes (212) located on the second section (204) of the motor head (200).

The produced fluids (102) flow inside of the shroud (806) on the outside of the motor (118) and the ESP seal (802). The produced fluids (102) exit the shroud (806) to enter the pump (124) through holes (212) located on the pump intake neck (804) of the pump intake (130). The pump (124), powered by the motor (118), pumps the produced fluids (102) into the production tubing (117) using the pump discharge (816). The pressure provided by the pump (124), allows the produced fluids (102) to travel out of the well (116) to the surface location (114).

In other embodiments, and in the inverted ESP string (112) configuration, the produced fluids (102) enter the inside of the production tubing (117) and travel up hole to the pump intake (130). The produced fluids (102) enter the pump (124) through the pump intake (130). The pump (124), powered by the motor (118), pumps the produced fluids (102) into the shroud (806) using holes (212) located on the pump discharge (816).

The produced fluids (102) flow inside of the shroud (806) on the outside of the motor (118) and the ESP seal (802). The produced fluids (102) exit the shroud (806) to enter the production tubing (117) using the holes (212) located on the second section (204) of the motor head (200). The pressure provided by the pump (124), allows the produced fluids (102) to travel out of the well (116) to the surface location (114).

Embodiments disclosed above describe specific examples of an ESP string (112) make up using specific components in a specific order. However, any ESP string (112) having the pump (124) and the motor (118) located up hole from the packer (142) and having the electrical connection between the motor (118) and the power cable (126) located outside of the flow of produced fluids using the motor head (200) may be used without departing from the scope of the disclosure herein.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for a well, the system comprising:

production tubing traversing a packer and disposed within the well;

an electric submersible pump connected to the production tubing and located up hole from the packer;

a motor located up hole from the packer, the motor configured to power the electric submersible pump;

a shroud encapsulating the motor, wherein the shroud isolates the motor from an external environment and contains a flow of produced fluids coming from the production tubing;

a motor head connected to the production tubing and extending from the external environment into the shroud, wherein the motor head comprises:

a first section having a first set of connection points, a second section having a first set of holes and located adjacent to the first section, a third section configured to be connected to an upper shroud hanger or a lower shroud hanger and located adjacent to the second section, a fourth section having a power inlet for connection to a power cable and located adjacent to the third section, and a fifth section having a second set of connection points and a second set of holes and located adjacent to the fourth section; and a power cable connected to the power inlet in the fourth section of the motor head, wherein the connection between the power cable and the power inlet occurs outside of the shroud and is isolated from the produced fluids by the packer and the shroud.

2. The system of claim 1, wherein the shroud further comprises a shroud body, the upper shroud hanger, and the lower shroud hanger.

3. The system of claim 2, wherein the first section, the second section, and the third section are located inside of the shroud and are in contact with the produced fluids and the fourth section and the fifth section are located outside of the shroud.

4. The system of claim 3, wherein the produced fluids enter the motor head from the production tubing through the second set of holes of the fifth section, and the produced fluids exits the motor head into the shroud through the first set of holes of the second section.

5. The system of claim 3, wherein the produced fluids enters the motor head from the shroud through the first set of holes of the second section and the produced fluids exits the motor head into the production tubing through the second set of holes of the fifth section.

6. The system of claim 1, further comprising a seal disposed between the motor and the electric submersible pump along the production tubing.

7. The system of claim 6, wherein the seal is encapsulated within the shroud.

8. The system of claim 1, wherein a plurality of phase pins extend through the motor head to transfer energy from the power cable to the motor.

9. A method for a well, the method comprising:

installing a production tubing into the well, the production tubing having an electric submersible pump, a motor encapsulated by a shroud, and a packer, wherein the electric submersible pump and the motor are located up hole from the packer;

powering the electric submersible pump by transferring energy from a power cable to the motor using a motor head, wherein the motor head comprises:

a first section having a first set of connection points, a second section having a first set of holes and located adjacent to the first section, a third section configured to be connected to an upper shroud hanger or a lower shroud hanger and located adjacent to the second section, a fourth section having a power inlet for connection to the power cable and located adjacent to the third section, wherein the fourth section is located outside of the shroud, and a fifth section having a second set of connection points and a second set of holes and located adjacent to the fourth section; and pumping produced fluids from an inside of the production tubing, into the shroud, into the electric submersible pump, and out of the well.

10. The method of claim 9, wherein the shroud further comprises a shroud body, the upper shroud hanger, and the lower shroud hanger.

11. The method of claim 10, wherein the first section, the second section, and the third section are located inside of the shroud and are in contact with the produced fluids and the fourth section and the fifth section are located outside of the shroud.

12. The method of claim 11, wherein the produced fluids enter the motor head from the production tubing through the second set of holes of the fifth section, and the produced fluids exits the motor head into the shroud through the first set of holes of the second section.

13. The method of claim 11, wherein the produced fluids enters the motor head from the shroud through the first set of holes of the second section and the produced fluids exits the motor head into the production tubing through the second set of holes of the fifth section.

14. The method of claim 9, further comprising a seal disposed between the motor and the electric submersible pump along the production tubing.

15. The method of claim 14, wherein the seal is encapsulated within the shroud.

16. The method of claim 9, wherein a plurality of phase pins extend through the motor head to transfer energy from the power cable to the motor.

* * * * *